US005503278A

United States Patent [19]

Ishmael

[11] Patent Number: 5,503,278

[45] Date of Patent: Apr. 2, 1996

[54] DOOR DISPLAY DEVICE

[75] Inventor: David L. Ishmael, Van Meter, Iowa

[73] Assignee: EMCO Enterprises, Inc., Des Moines, Iowa

[21] Appl. No.: 287,132

[22] Filed: Aug. 8, 1994

[51] Int. Cl.[6] ..... A47F 7/00

[52] U.S. Cl. ..... 211/169; 206/325; 211/96

[58] Field of Search ..... 211/96, 168, 169, 211/169.1; 206/325

[56] References Cited

U.S. PATENT DOCUMENTS

| | | | |
|---|---|---|---|
| 2,194,238 | 3/1940 | Weaver | 211/169 X |
| 2,584,255 | 2/1952 | Brown | 211/169 |
| 3,391,796 | 7/1968 | Cross | 211/169 |
| 3,664,514 | 5/1972 | Drake | 211/169 |
| 3,777,896 | 12/1973 | Ehrlich | 211/169 X |
| 4,270,290 | 6/1981 | Eckert | 211/169 X |

FOREIGN PATENT DOCUMENTS

| | | | |
|---|---|---|---|
| 566394 | 11/1923 | France | 211/169.1 |

*Primary Examiner*—Robert W. Gibson, Jr.
*Attorney, Agent, or Firm*—Zarley, McKee, Thomte, Voorhees, & Sease

[57] ABSTRACT

A door display device is adapted to be mounted to a vertical support, and includes a rectangular display frame having a rectangular display opening therein. The display frame is pivotally mounted to a vertical support for pivotal movement about a vertical display axis. A door assembly may be fitted within the display opening of the rectangular display frame and secured in place. Indicia panels may be provided within the rectangular display opening of the display frame.

14 Claims, 6 Drawing Sheets

10
12
14
16
20
22
24
44
50
52
54
56
58
60
62
65
66
68
70
72
74
76
78
80
82
84
86
87
88
90
92
98
100
102
110
112

DOOR DISPLAY DEVICE

BACKGROUND OF THE INVENTION

This invention relates to a door display device

The marketing of doors to the do it yourself home improver, or to contractors and professional carpenters, requires a door display device which can make the door readily accessible for inspection by the customer. Such door display devices must be capable of quick and simple construction at the point of sale, and must be capable of displaying the door in a functional condition so that the customer can operate the door and see how the door appears in an installation. The display device must be constructed in such a manner that it permits the display of numerous doors while utilizing a minimum of floor space at the point of sale.

Therefore a primary object of the present invention is the provision of an improved door display device.

A further object of the present invention is the provision of an improved door display device which can be quickly and easily assembled and disassembled at the point of sale.

A further object of the present invention is the provision of an improved door display device which permits a plurality of doors to be displayed in side to side relation while at the same time occupying a minimum of floor space.

A further object of the present invention is the provision of an improved door display device which provides adequate means for displaying advertising and other product information in association with the door display.

A further object of the present invention is the provision of an improved door display device which is economical to manufacture, durable in use and efficient in operation.

SUMMARY OF THE INVENTION

The foregoing objects may be achieved by a door display device adapted to be mounted to a vertical support. The door display device includes a rectangular display frame comprising a pair of spaced apart side display frame members, a top display frame member, and a bottom display member forming a rectangular display opening. Display mounts are provided for pivotally mounting the display frame to the vertical support for pivotal movement about a vertical display axis. A door assembly is fitted within and detachably mounted within the display opening. The door assembly includes a rectangular door frame forming a rectangular door opening, a door within the door opening, and a door hinge pivotally mounting the door to the door frame for swinging movement about a vertical door axis.

DETAILED DESCRIPTION OF THE PREFERRED EMBODIMENT

Figure 1:
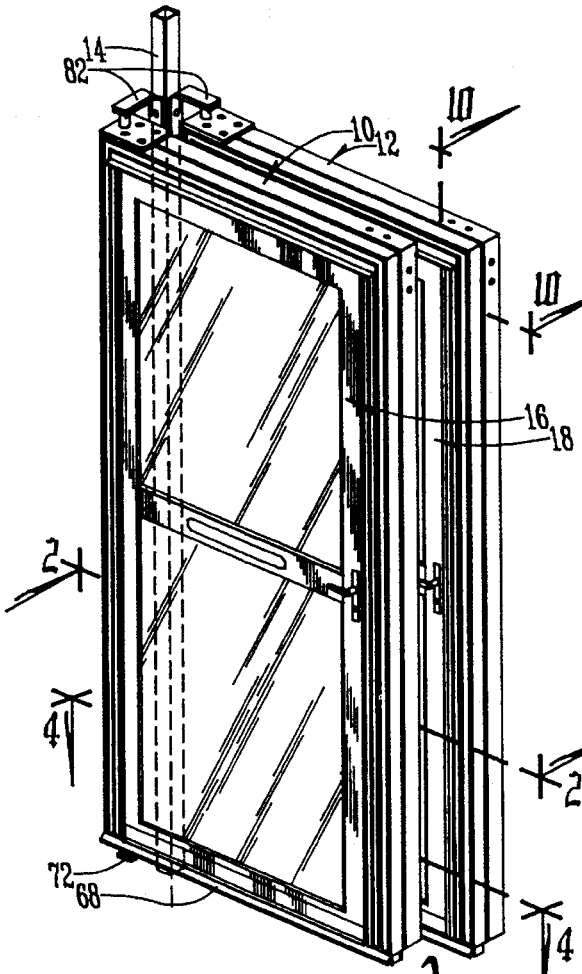
FIG. 1 is a pictorial view of two of the door display devices of the present invention.

Referring to FIG. 1 a first door display 10 and a second door display 12 are shown pivotally mounted to a support post 14. Support post 14 can be part a of typical scaffolding as might be commonly used in a commercial home improvement store offering doors for sale. Mounted within each of the first and second door displays 10, 12, are door assemblies 16, 18, respectively.

Figure 8:
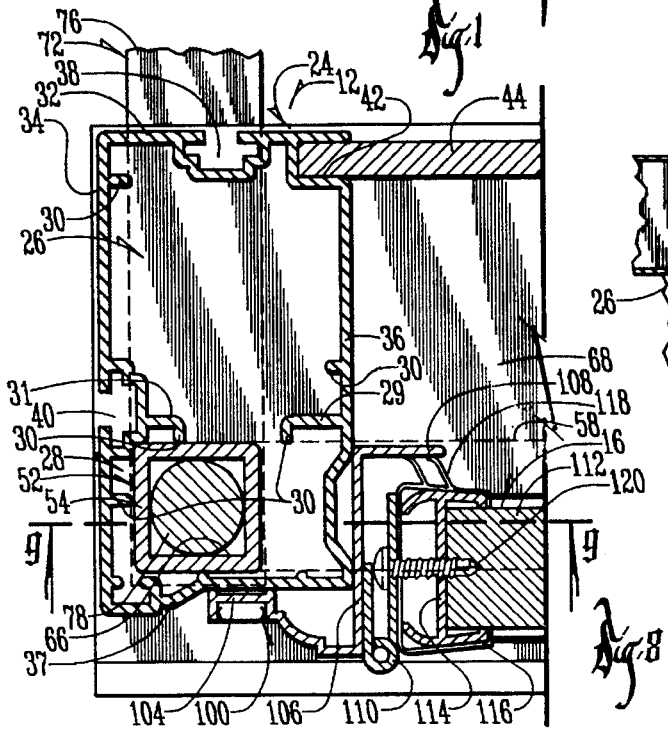
FIG. 8 is a sectional view taken along line 8—8 of FIG. 2.
Figure 3:
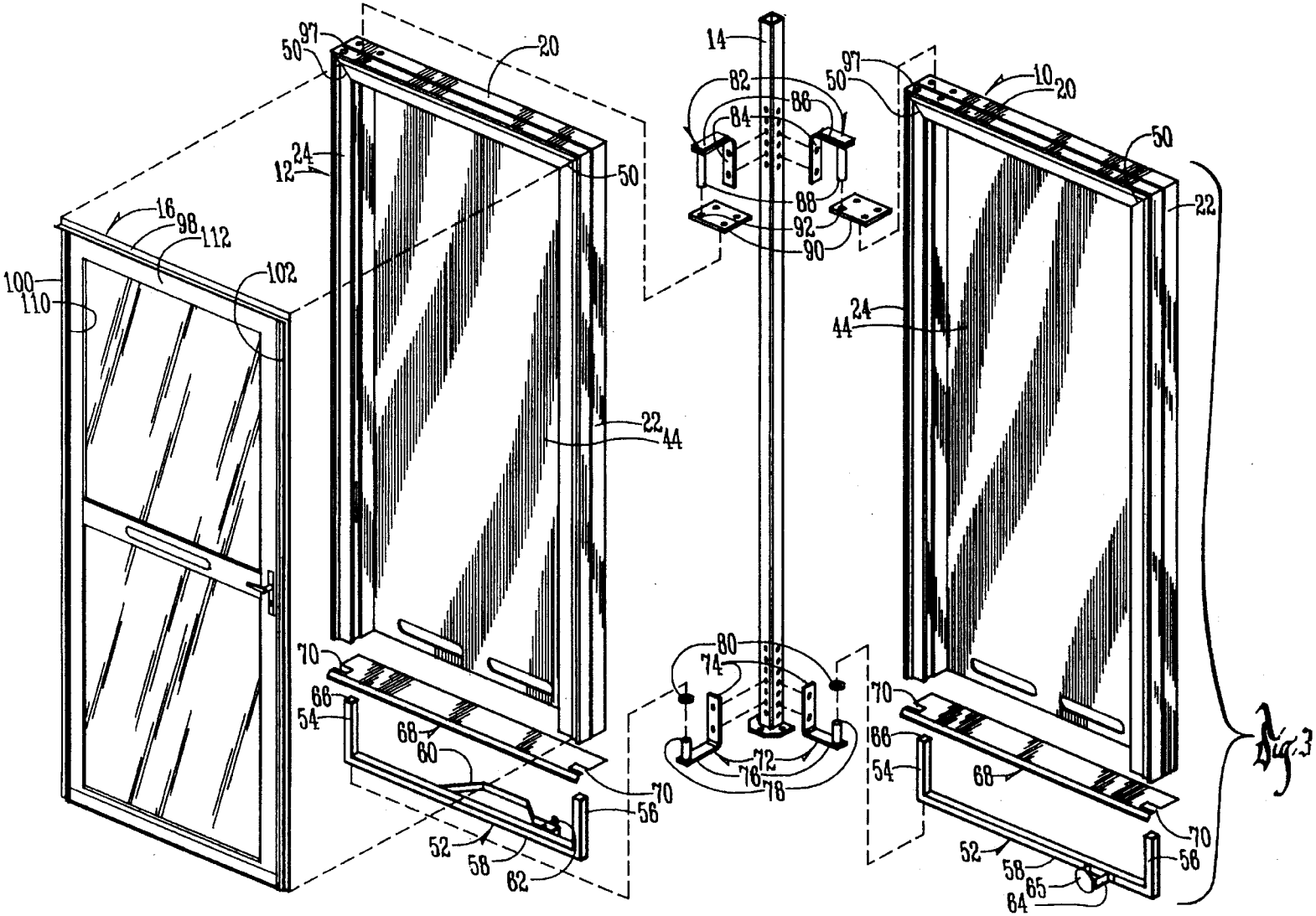
FIG. 3 is an exploded pictorial view of the two door display devices shown in FIG. 1.

The parts of each door display are shown in FIG. 3 and include a top frame member 20 and two side frame members 22, 24, each of which are formed of an extruded aluminum material. The cross section of the extrusion is best shown in FIG. 8 and includes a first tube 26 and a second tube 28 which are separated by a pair of opposite inwardly extending spaced apart webs or walls 29, 31. A plurality of stand-off ridges 30 extend inwardly into the first and second tubes 26, 28. Each extrusion includes a rear face 32, an outer face 34, and inner face 36, and a front face 37 which is preferably in the shape of a conventional brick molding. Rear face 32 includes a vertical longitudinal screw slot 38 which is generally C-shaped in cross section. A similar C-shaped screw slot 40 is provided in the outer surface 34. The interior surface at the rear edge thereof includes a U-shaped slot 42 in which is fitted a rectangular panel 44. Panel 44 can be used to display point of sale printed matter for marketing the door in the display.

Figure 10:
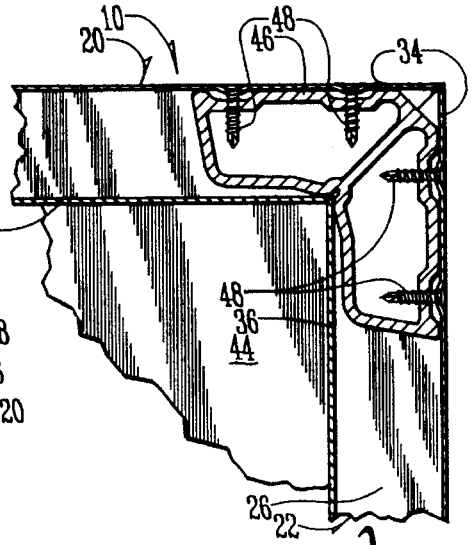
FIG. 10 is a sectional view taken along line 10—10 of FIG. 1.
Figure 7:
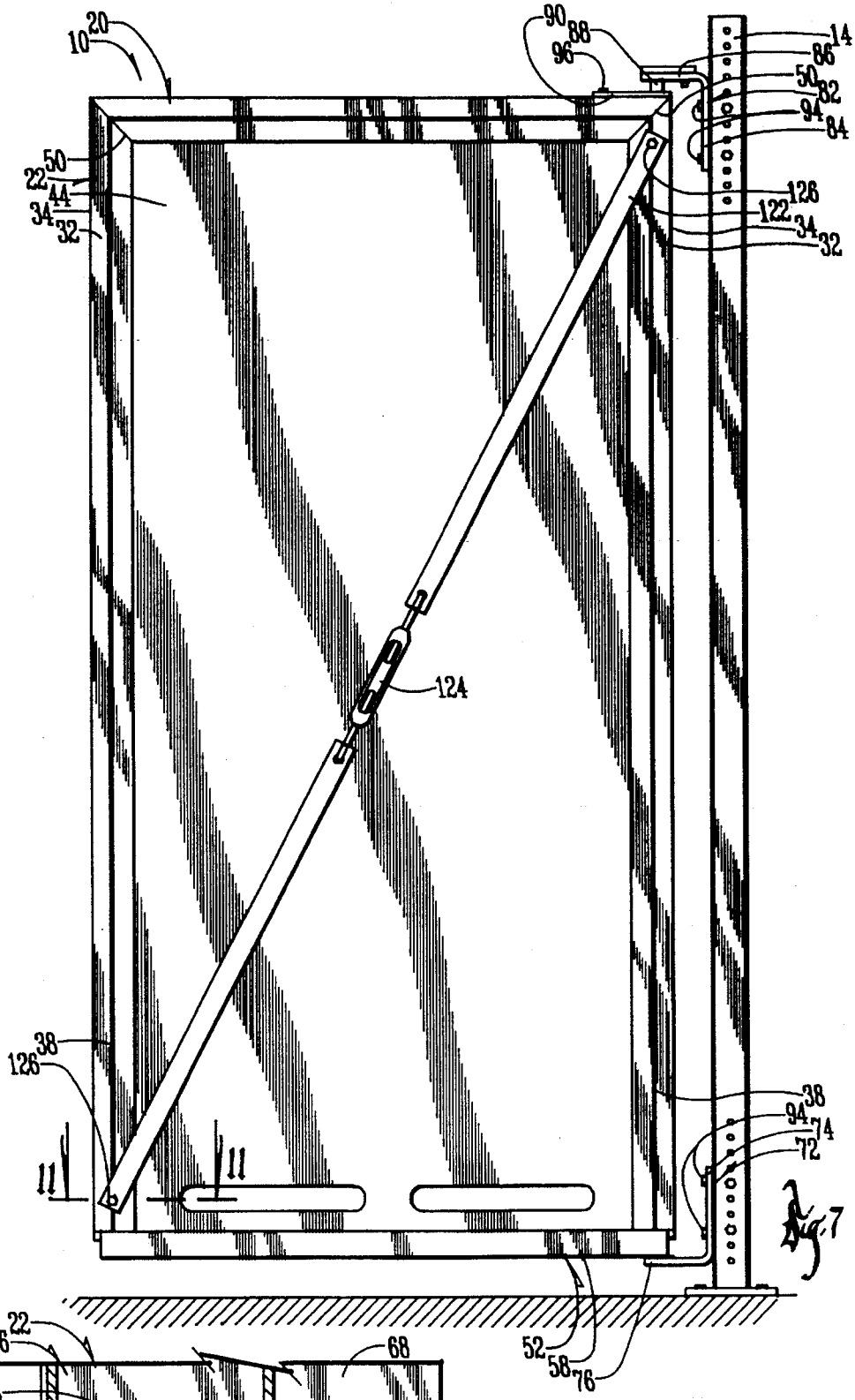
FIG. 7 is a rear elevational view of the door display device.

The two side members 22, 24, are joined at their upper ends with the top frame member 20 in a miter joint 50 (FIG. 7) and are held in place by L-shaped brackets 46 (FIG. 10) which fit within the first tube 26 and which are secured in place by means of screws 48.

Figure 4:
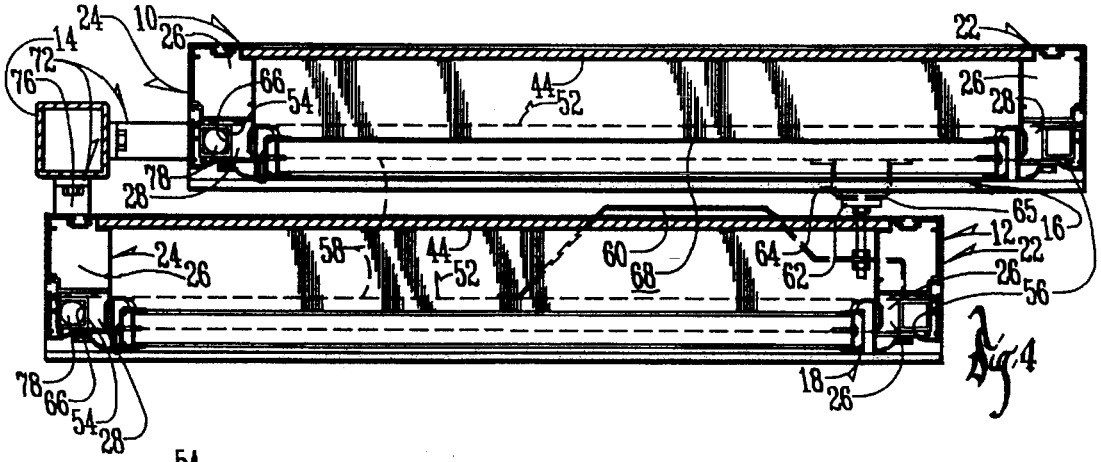
FIG. 4 is a sectional view taken along line 4—4 of FIG. 1.
Figure 5:
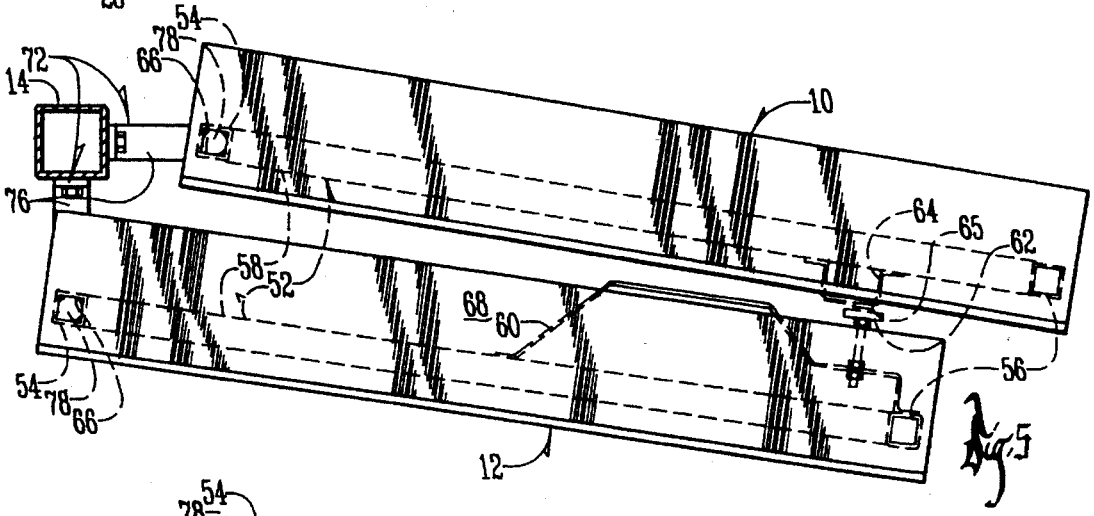
FIGS. 5 and 6 are views similar to FIG. 4, but showing the two door display devices in slightly different positions with respect with one another.
Figure 6:
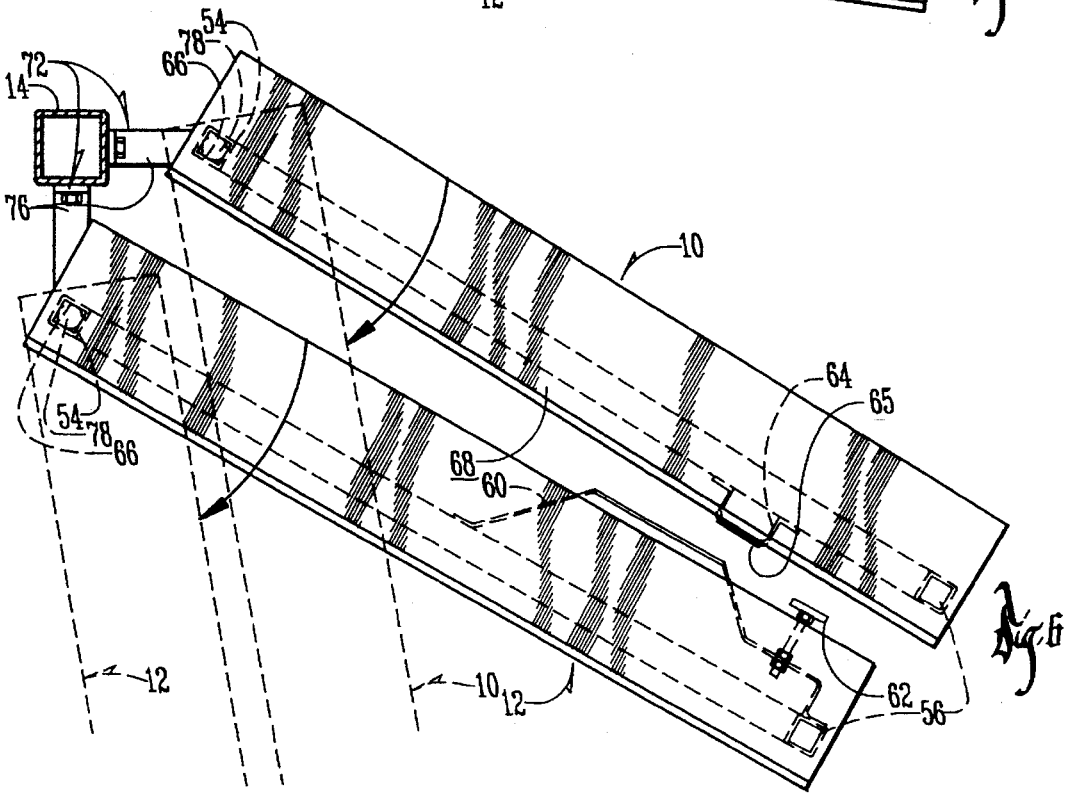

The lower ends of side frame members 22, 24, are joined together by a U-shaped bottom frame 52 which is comprised of a pair of upstanding legs 54, 56, joined by a horizontal bar 58. Horizontal bar 58 of the door assembly 12 includes a trapezoidal glide bracket 60. A magnet 62 is operatively attached to one end of glide bracket 60. The horizontal bar 58 of door assembly 10 includes a rectangular glide bracket 64 having a disc 65 presented toward magnet 62 as can be seen in FIGS. 4–6. The lower ends of upstanding legs 54 and 56 are tubular so as to provide a pivot hole 66 (FIG. 8) for receiving a pivot pin 78. A threshold plate 68 includes notches 70 at its ends, and these notches 70 are sized to fit around the upstanding legs 54, 56, of U-shaped bottom frame 52. The upstanding legs 54, 56, are force fitted into the second tube 28 of the side frame members 22, 24, in the manner shown in FIG. 8 and are forced upwardly until the bar 58 presses the threshold plate 68 against the lower ends of side frame members 22, 24, in the manner shown in FIG. 2.

Figure 9:
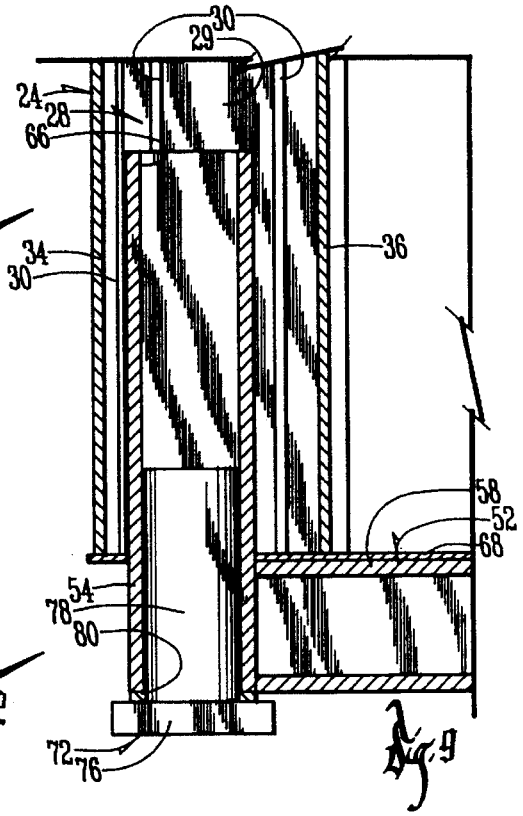
FIG. 9 is a sectional view taken along line 9—9 of FIG. 8.

A bottom hinge bracket 72 includes a vertical leg 74 and a horizontal leg 76. Extending upwardly from horizontal leg 76 is a hinge pin 78 having a bearing washer 80 fitted thereto. The hinge pin 78 is fitted upwardly within the pivot hole 66 provided by the tubular construction of side frame member 54 in the manner shown in FIGS. 8 and 9.

Figure 2:
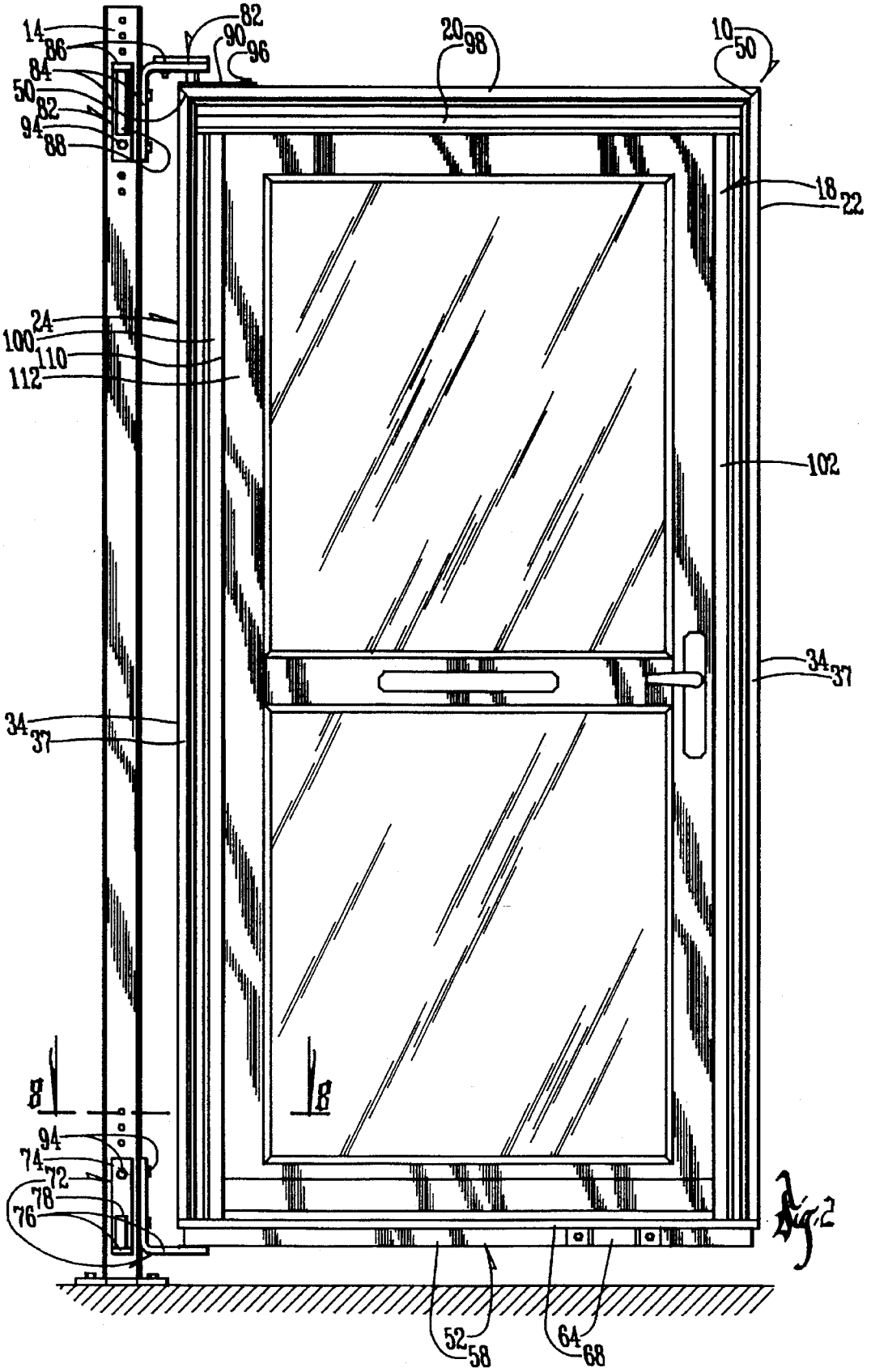
FIG. 2 is a front elevational view taken along line 2—2 of FIG. 1.

A top hinge bracket 82 includes a vertical leg 84 and a horizontal leg 86. Extending downwardly from horizontal leg 86 is a hinge pin 88 which extends through an upper hinge pin hole 92 in a reinforcing plate 90. Reinforcing plate 90 is attached to the upper surface of the top frame member 20 by means of bolts 96 (FIG. 2). A hinge pin hole 97 (FIG. 3) is provided in the upper frame member 20 and is registered with the hole 92 in the reinforcing plate 90 for receiving the hinge pin 88. The vertical legs 74, 84, of brackets 72, 82, respectively are mounted to the vertical support 14 by means of bolts 94, and thus provide a pivotal hinge mounting of the door assemblies 10, 12, for pivotal movement about vertical axes coinciding with the pins 78, 88.

Fitted within the display frames 10, 12, are door assemblies 16, 18, each of which include a top frame 98 and two opposite Z-bars 100, 102, extending downwardly therefrom. The Z-bars are shown in cross section in FIG. 8 and include a front leg 104 which is secured by screws (not shown) to the front surface 37 of the side frame members 22, 24, as shown in FIG. 8. A middle leg 106 fits against the interior surface 36 of side frame members 22, 24, and a rear leg 108 extends a right angles thereto. A hinge 110 is secured by means of screws 120 to a door 112 and also to the Z-bar 100. The door 112 includes a door side bracket 114 having a plastic side cap 116 fitted thereover. The plastic side cap includes sealing fins 118 which seal against the rear leg 108 of the Z-bar 100.

Figure 11:
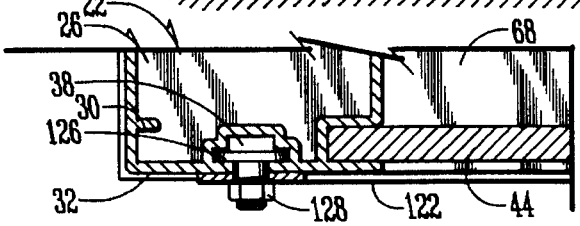
FIG. 11 is a sectional view taken along line 11—11 of FIG. 7.

On the rear surfaces of each of the door displays 1, 12, is a diagonal strap 122 which includes a turnbuckle 124 at its center and which is secured diagonally across the rear of the door assembly 10 by screws 126 which are slidably mounted within the screw slots 38 as shown in FIG. 11. A nut 128 holds the diagonal strap 122 in place, and the frame can be squared up by adjusting the turn buckle 124.

Referring to FIGS. 4, 5, and 6, the glide brackets 60, 64, the magnet 62, and the disc 65 permit two door assemblies 10, 12 to be mounted to the single support post 14, and permit these door assemblies to be pivoted to various positions without interfering with one another or without breaking the door assemblies 16, 18, therein. The magnet 62 and disc 65, engage one another in the various positions shown in FIGS. 4, 5, and 6 so as to keep the door assemblies separate from one another. In some positions (not shown) the bracket 60 slides on disc 65. This permits customers to swing the door assemblies 10, 12 to various positions without damaging the door assemblies mounted therein.

Figure 12:
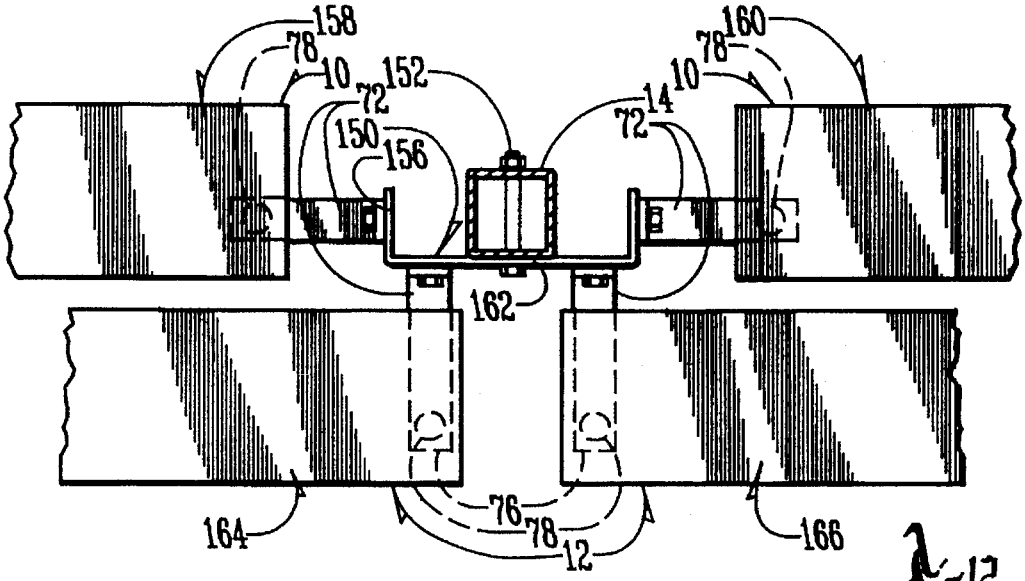
FIG. 12 is a sectional view of a modified bracket structure which permits the mounting of four door displays to a single vertical post.

Referring to FIG. 12, a U-shaped bracket 150 can be mounted to post 14 by means of bolts 152. Bracket 150 has wings 154, 156 which can accommodate two sets of L-shaped brackets 72 so as to permit two door displays 158, 160 to be mounted thereon. Bracket 150 has a central web 162 sufficiently long to accommodate two additional L-shaped brackets 72 and two additional door displays 164, 166.

In the drawings and specification there has been set forth a preferred embodiment of the invention, and although specific terms are employed, these are used in a generic and descriptive sense only and not for purposes of limitation. Changes in the form and the pro-portion of parts as well as in the substitution of equivalents are contemplated as circumstances may suggest or render expedient without departing from the spirit or scope of the invention as further defined in the following claims.

What is claimed is:

1. A door display device adapted to be mounted to a vertical support comprising:

a rectangular display frame comprising a pair of spaced apart side display frame members, a top display frame member, and a bottom display frame member forming a rectangular display opening;

display mounting means for pivotally mounting said display frame to said vertical support for pivotal movement about a vertical display axis;

a door assembly fitted within and detachably mounted within said display opening, said door assembly comprising a rectangular door frame forming a rectangular door opening, a door within said rectangular door opening, and door hinge means pivotally mounting said door to said door frame for swinging movement about a vertical door axis.

2. A door display device according to claim 1 wherein said spaced apart side display members each include a lower end having an elongated vertical opening therein, said bottom display frame member being U-shaped with two spaced apart upstanding legs and a horizontal leg extending therebetween, said U-shaped legs each being telescopically fitted and secured within one of said vertical openings of one of said side display members.

3. A door display device according to claim 2 wherein an elongated threshold plate includes opposite ends extending below said lower ends of said lower ends of said side display members.

4. A door display device according to claim 3 wherein said threshold plate is positioned between said horizontal leg of said bottom display member and said lower ends of said side display members.

5. A door display device according to claim 1 wherein said top display frame member, and said pair of side display frame members each include a first elongated hollow tube therein and each have identical cross sectional shapes and sizes.

6. A door display device according to claim 5 wherein each of said top display frame member and said pair of side display frame members are extrusions.

7. A door display device according to claim 6 wherein said extrusions each include a second elongated tube therein separated from said first elongated tube by a web wall.

8. A door display device according to claim 7 wherein top display frame member includes mitered opposite ends and said opposite side display frame members each include a mitered top end joined to one of said mitered opposite ends of said top display frame member.

9. A door display device according to claim 8 and further comprising first and second L-shaped brackets joining said upper ends of said mitered opposite ends of said top display frame member to said mitered top ends of said opposite side display frame members, said L-shaped brackets each having a first L-leg extending into said first elongated tube of said top display members and a second L-leg extending into said first elongated tube of one of said side display members.

10. A door display device according to claim 9 wherein said bottom display frame member is U-shaped with first and second upstanding legs joined by a horizontal leg, said first and second upstanding legs each extending upwardly within said second tube of one of said side display frame members.

11. A door display according to claim 7 wherein each of said top and side display frame members include an internal surface facing toward said display opening and an elongated recessed channel extending along the length thereof.

12. A door display according to claim 11 and further comprising a rectangular panel having a top edge and opposite side edges fitted within said recessed channels of said top and side display frame members respectively.

13. A door display device according to claim 11 wherein each of said top and side display frame members include a rear surface and an outer surface with an elongated rear channel and an elongated outer channel extending along the lengths thereof respectively.

14. A door display device according to claim 13 wherein said rear and outer channels are each C-shaped in cross section.

* * * * *